United States Patent [19]

Dietzsch

[11] 4,344,482

[45] Aug. 17, 1982

[54] MULTIPLE FLOW CONDENSER FOR AIR CONDITIONING UNITS OF MOTOR VEHICLES

[75] Inventor: Kurt Dietzsch, Leonberg-Eltingen, Fed. Rep. of Germany

[73] Assignee: Suddeutsche Kuhlerfabrik Julius Fr. Behr GmbH & Co. KG, Fed. Rep. of Germany

[21] Appl. No.: 221,326

[22] Filed: Dec. 29, 1980

[30] Foreign Application Priority Data

Dec. 29, 1979 [DE] Fed. Rep. of Germany ..... 2952736

[51] Int. Cl.[3] ..... F28F 9/22; F28F 9/26

[52] U.S. Cl. ..... 165/172; 165/150

[58] Field of Search ..... 165/150, 151, 172; 62/526

[56] References Cited

U.S. PATENT DOCUMENTS

| | | | |
|---|---|---|---|
| 1,936,284 | 11/1933 | Bergman | 165/172 X |
| 2,640,687 | 6/1953 | Throckmorton | 165/172 X |
| 2,792,201 | 5/1957 | Whistler, Jr. | 165/150 X |
| 3,346,043 | 10/1967 | Thurnauer | 165/172 X |
| 3,368,614 | 2/1968 | Anderson | 165/151 X |
| 3,941,187 | 3/1976 | Jabsen et al. | 165/175 X |
| 4,063,431 | 12/1977 | Dankowski | 62/239 |
| 4,159,740 | 7/1979 | Seiling | 62/526 X |

FOREIGN PATENT DOCUMENTS

| | | | |
|---|---|---|---|
| 565014 | 1/1924 | France | 165/150 |
| 780061 | 7/1957 | United Kingdom | 165/172 |

*Primary Examiner*—Sheldon J. Richter

*Attorney, Agent, or Firm*—Craig and Antonelli

[57] ABSTRACT

A heat exchanger, especially a double-flow or multiple-flow condenser for air conditioning units of motor vehicles which includes V-shaped tube forks installed in a heat exchanger body. The tube forks are connected at their ends by the tube elbows to tube forks located downstream in the flow direction, wherein an influx of heat exchange medium is distributed between two or among several of the first mentioned tube forks. The legs of all tube forks are arranged in one plane one below the other and their ends are connected by tube sections, with each of the tube sections bridging at least two ends of adjacent tube forks and extend laterally past each other.

13 Claims, 2 Drawing Figures

MULTIPLE FLOW CONDENSER FOR AIR CONDITIONING UNITS OF MOTOR VEHICLES

Figure 1:
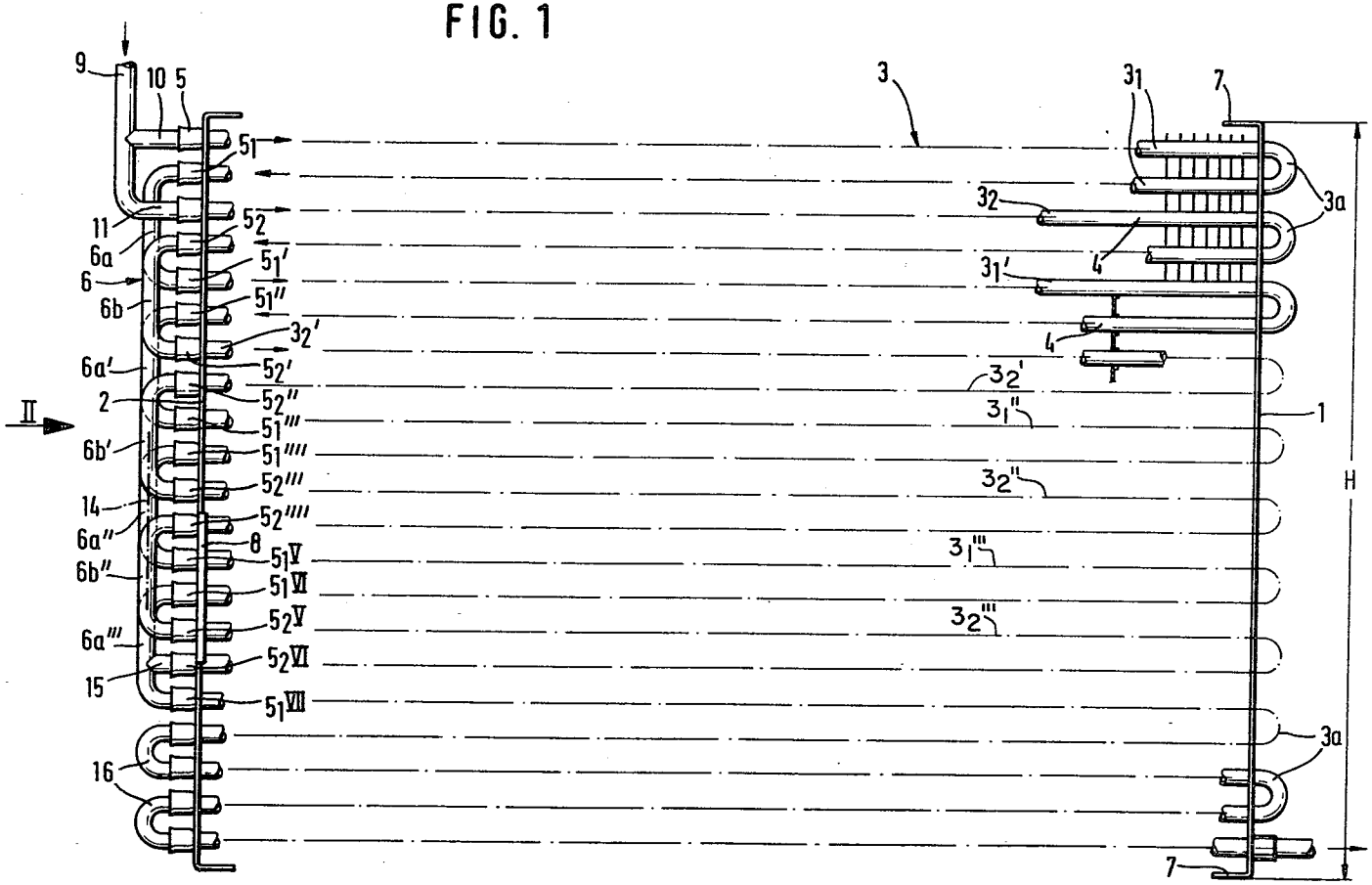

The present invention relates to a heat exchanger and, more particularly, to a double-flow or multiple-flow condenser for air conditioning units of motor vehicles, which includes U-shaped tube forks installed in a heat exchanger body, with the tube forks being connected at their ends by tube elbows to tube forks located downstream in a flow direction, wherein an influx of heat exchange medium is distributed between two or among several of the first tube forks.

Heat exchangers of the aforementioned type are disclosed in, for example, U.S. Pat. No. 4,063,431 wherein a condenser is provided having a double-flow construction. In these proposed constructions, two tube systems are provided, which, in a mutually parallel relationship, are traversed by heat exchange medium, wherein the individual tube forks and tube elbows are disposed in two mutually parallel planes.

While heat exchanger constructions of the aforementioned proposed type have, over condensers where only one flow conductance means is provided, the advantage that the heat exchange medium flowing therethrough experiences a lower pressure drop due to the larger flow cross section and lower flow velocity connected therewith, a disadvantage resides in the fact that the heat exchangers are relatively thick or large as measured in a direction of the flow of air therethrough. This disadvantage is even more significant in connection with the use of such a heat exchanger in a motor vehicle since normally only very small installation room is available for condensers of air conditioners. Consequently, assembly difficulties are frequently encountered in the case of double-flow or double row condensers.

The aim underlying the present invention essentially resides in providing a heat exchanger, especially a condenser for air conditioning units of motor vehicles, which is constructed in such a manner that the installation space required, at least in a flow direction of the air, can be kept very small.

In accordance with advantageous features of the present invention, legs of all the tube forks are arranged in one plane one beneath the other and their ends are joined by tube sections, with each of the tube sections bridging at least two ends of the adjacent tube forks and extending laterally past one another. The advantage of this configuration resides in the fact that, in a zone or area of the heat exchange surface, in a direction of the throughflowing air, the condenser can be made relatively thin and yet still preserve the advantages of a double-flow system. Thus, condensers fashioned in accordance with the present invention can be installed much more easily in an area of the motor vehicle in front of the engine radiator lying in a forward region since they require only a very small installation space, as measured in a longitudinal direction of the vehicle and/or in a direction of air flow.

Advantageously, in accordance with further features of the present invention, the tube sections are bent in one plane in a conventional manner but are installed with their elbow parts pointing in different directions. The tube elbows can then be extended past one another in a very simple manner and, although this imparts to the structural member a larger thickness in a region which normally lies at the side than in a zone of the heat exchanger surface, such larger thickness can be accommodated in an area of the lateral edges since such area may be extended beyond a zone of the lateral edges of the engine radiator wherein, in motor vehicles, there is generally a sufficient space available.

A further advantage of the present invention resides in the fact that all tube sections may be of identical construction so that also from a manufacturing viewpoint sufficiently large number of parts are available.

An additional advantage of the present invention resides in the fact that the condenser requires no modifications of series-produced condensers which were manufactured as single-flow units and merely by changing conventional tube elbows by the novel tube elbows of the present invention which, in each case bridge at least two adjacent connecting ends, the condenser body of the present invention is created.

For double-flow designs of condensers, in accordance with further advantageous features of the present invention, all tube sections are arranged with their elbow parts in a plane extending perpendicularly to a plane in which the legs of the tube forks extend. By virtue of this arrangement, the tube sections may essentially exert a shape of a V, the legs of which form an obtuse angle. It has been found that such tube elbows may be manufactured in a very simple manner and yet have the advantage that they can be installed with their legs in parallel to legs of adjacent tube elbows so that a compact arrangement is achieved along a side of a condenser.

In a suitable manner it is also possible in accordance with the present invention to provide the double-flow arrangement of the tube forks only to about 60–70% of the heat exchange surface which may then be followed by a single flow arrangement. This configuration may be readily realized by conventional means. Such a configuration is possible because in this end zone of the condenser the largest portion of the heat exchange medium has passed over into the liquid phase and, consequently, has a substantially lower volume than in the zone where the heat exchange medium enters the condenser.

Advantageously, in accordance with further features of the present invention, the tube sections have three radii of curvature, of which a central radii of curvature lies between the legs of the elbow parts and the two other constitute a transistion from the legs of the elbow parts to the ends of the tube forks.

Accordingly, it is an object of the present invention, especially for air conditioning units in motor vehicles, which avoids, by simple means, shortcomings and disadvantages encountered in the prior art.

Another object of the present invention resides in providing a heat exchanger, especially a multiple flow condenser for air conditioning units of motor vehicles, which minimizes the thickness of the condenser in the direction of air throughflow.

Yet another object of the present invention resides in providing a heat exchanger, especially a multiple flow condenser for air conditioning units in motor vehicles, which is simple in construction and therefore relatively inexpensive to manufacture.

A further object of the present invention resides in providing a heat exchanger, especially a multiple-flow condenser for air conditioning units in motor vehicles which requires only a very small installation space in the motor vehicle.

Yet another object of the present invention resides in providing a heat exchanger, especially a multiple-flow condenser for air conditioning units of motor vehicles which functions realiably under all operating conditions.

Figure 2:
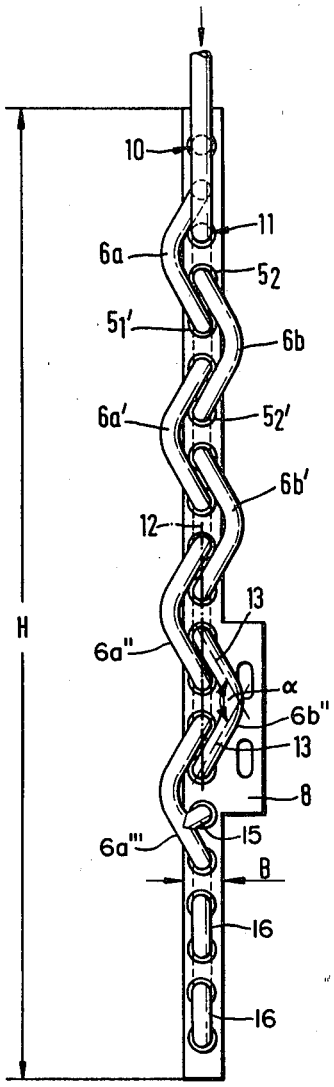

These and other objects, features, and advantages of the present invention will become more apparent from the following description when taken in connection with the accompanying drawings which show, for the purposes of illustration only, one embodiment in accordance with the present invention, and wherein:

FIG. 1 is a schematic, partially broken away view, of a condenser arrangement for an air conditioning unit of a motor vehicle constructed in accordance with the present invention; and FIG. 2 is an elevational view taken in a direction of the arrow II in FIG. 1.

Referring now to the drawings wherein like reference numerals are used in both view to designate like parts and, more particularly, to FIG. 1, according to this figure, a heat exchanger body of a condenser for an air conditioning unit of a motor vehicle includes two lateral or side holding members or plates 1, 2 which are adapted to hold a plurality of tube forks generally designated by the reference numeral 3. The tube forks 3 are conventionally passed through bores in the holders 1, 2 and are each provided with heat exchange plates which are placed in a gill-type fashion over the legs of the tube forks, with the heat exchange plates being secured in position in a conventional manner. Tube elbows 3*a* or the individual tube forks 3 project beyond a side wall 1 disposed at the right hand portion of FIG. 1. Free ends of legs 4 of the tube forks are each widened, in a conventional manner, to form so-called bells 5 into which connecting tube sections 6 are then mounted so as to enable a completion of a flow path for a heat exchange medium.

The lateral holders or side walls 1, 2 are each bent at their ends into mounting lugs 7 to which may be fastened, in a manner not illustrated in the drawings, a cover and a bottom member and also, optionally, connecting angles, so as to enable the heat exchanger body to be installed in a motor vehicle, preferably, forwardly of an engine radiator. Additionally, for this purpose, the left hand side wall or holder 2 may also be provided with a lug 8.

As shown in the drawings, a heat exchange medium is introduced into the condenser through a conduit 9 and is then distributed over two connecting tube sections 10, 11 to two tube systems simultaneously traversed by the heat exchange medium thereby resulting in a double-flow condenser arrangement. As shown most clearly in FIG. 1, the tube section 10 is connected to the bell 5 of the uppermost leg of the first tube fork $3_1$, a second leg of which terminates at a bell $5_1$ and is extended, through a tube section 6*a*, to a bell $5_{1'}$ leading to the second tube fork $3_{1'}$. a bell $5_{1''}$ of the second tube fork $3_{1'}$, as viewed in a flow direction of the heat exchange medium, is connected, through a tube section 6*a'* to a bell $5_{1'''}$ of a subsequent tube fork $3_{1''}$ of the first flow path. A bell $5_{1''''}$ of the subsequent tube fork $3_{1''}$ is connected by way of a tube section 6*a''* to a bell $5_1^V$ of a further tube fork $3_{1'''}$.

The second connecting section 11 leads to the bell $5_2$ of a first tube fork $3_2$ of a second flow path for the heat exchange medium. The Bell member $5_2$, seated at an end of the tube fork $3_2$, is connected through a tube section 6*b* to a bell $5_{2'}$ of a second tube fork $3_{2'}$ of the second flow path. A bell $5_{2''}$ of the subsequent fork tube $3_{2'}$ is connected, through a connecting piece 6*b'*, to a bell $5_{2'''}$ of a further fork tube $3_{2''}$, with a bell $5_{2''''}$ of the further fork tube $3_{2''}$ being connected, by a connecting piece 6*b''* to a bell $5_2^V$ of a fork tube $3_{2'''}$.

By virtue of the above noted features, a condenser is created having a double-flow conduit system wherein, as shown most clearly in FIG. 2, the axes of all legs 4 of the tube forks for both flow systems are arranged in a single plane 12 one below the other. As also shown in FIG. 2, the tube section 6*a*, 6*b* and 6*a'* and 6*b'* and all subsequent corresponding tube sections 6*a*, 6*b*, and 6*a'* and 6*b'* are extended laterally past one another. This is achieved by virtue of the fact that the tube sections 6*a* and 6*b*, all of which are identical to one another but are arranged twisted with respect to each other by 180°, have a V-shaped configuration with two legs 13 of the respective connecting pieces or tube sections, as indicated in phantom line in FIG. 2, forming an obtuse angle elbow between them. This arrangement provides the advantageous possibility that the legs 13 of the individual tube sections 6*a*, 6*b* may be located in parallel with each other over a certain distance and, as shown in FIG. 1, may, in turn, be disposed with their axes in a common plane 14 extending at right angles to the plane 12 when the legs 4 of the individual tube forks $3_1$, $3_2$, etc are a arranged. The V-shape of the tube sections 6*a*, 6*b*, etc also have the advantage that a relatively simple manufacturing is possible thereby since the thus configured tube sections need only be bent respectively at the guiding elbows to the bells $5_1$, $5_2$, etc. and by an angle $\alpha$.

Rather than bending the legs 13 into a substantially V-shaped configuration, it is also possible to replace one elbow by the angle $\alpha$ by two elbows with a linear connecting member so that the tube sections 6*a*, 6*b*, etc. essentially exhibit a trapezoidal shape in a top view of FIG. 2; however, such a construction would require greater expenses from a manufacturing viewpoint and the only advantage attained thereby would be that the spacing of the outermost ends of the elbows of the tube sections 6*a*, 6*b*, etc., measure at right angles to the plane 12, would be smaller.

As also shown in FIGS. 1 and 2, the double-flow arrangement passes over, after about 60–70% of the height H of the entire condenser, into a single flow construction. For this purpose, the end of the second flow path, namely, the bell $5_2^{VI}$, is conducted, through a connecting member 15 into the first flow path, namely, into the tube section 6*a'''* connected with bell $5_1^{VI}$ of the tube fork $3_{1'''}$ shortly before the tube section 6*a'''* terminates in a bell $5_1^{VII}$. From a leg of the tube fork leading away from the bell $5_1^{VII}$, the heat exchange medium then flows in a single stream mode and the two elbows 3*a*, respectively projecting beyond the side wall 1, are associated on the left hand side with elbows 16 projecting beyond the side wall 2, which tube elbows 16 are, in turn, identical to the tube elbows 3*a*.

As shown most clearly in FIG. 2, a great advantage of the novel arrangement of the present invention resides in the fact that the condenser body has only a very small width B over its entire heat exchange surface that is, over an entire zone between the two side walls or lateral holders 1, 2, thereby making it possible to install such condenser bodies, even in cases of very restricted space conditions forwardly of an engine radiator, into motor vehicles. It is merely on a side projecting beyond the side wall or lateral holder 2 that the condenser body have any large depth; however, such increase in depth would not cause any installation problems since the larger depth would be disposed outside the lateral end of the engine radiator.

As can readily be appreciated, the condenser described hereinabove with respect to a double flow can also be realized not only in the case of double flow arrangements but also in case of multiple flow systems. Thus, it would be readily possible in a double flow arrangement and with the same construction of the tube forks $3_1$, $3_2$, etc., to, for example, achieve a triple flow arrangement if in place of the provided tube section *6a*, *6b* respectively bridging two subsequent connecting ends of the tube forks pertaining to the other system, for example, the tube section *6b* bridging the bells $5_{1'}$ and $5_{1''}$, there would be provided tube sections which would bridge not only two but four connection places of adjacent tube forks, wherein again respectively two of these bridged ends would pertain to one system of the multiple flow system. These connecting tube sections could be laterally extended beyond one another in three planes located independently of one another.

While I have shown and described only one embodiment in accordance with the present invention, it is understood that the same is not limited thereto but is susceptible of numerous changes and modifications as known to one having ordinary skill in the art, and I therefore do not wish to be limited to the details shown and described herein, but intend to cover all such modifications as are encompassed by the scope of the appended claims.

I claim:

1. A multiple flow heat exchanger comprising a heat exchanger body, a plurality of tube forks arranged in the heat exchanger body, some of said tube forks defining a first flow path for a heat exchange medium and the remaining tube forks defining at least one further flow path for the heat exchange medium, each of the tube forks has a substantially U-shape and include a pair of legs with each leg terminating in a free end, and elbow means for connecting free ends of respective tube forks with free ends of tube forks located downstream, as viewed in a flow direction of the heat exchange medium, so as to enable a flow of the heat exchange medium in the respective flow paths, characterized in that the plurality of tube forks are arranged in the heat exchanger body in such a manner that the legs of all of the tube forks are arranged in one plane, the elbow means includes tube sections, and in that the tube sections bridge at least two free ends of adjacent tube forks and extend laterally past each other.

2. A heat exchanger according to claim 1, characterized in that the heat exchanger is a condenser for an air conditioning unit of a motor vehicle.

3. A heat exchanger according to one of claims 1 or 2, characterized in that each of the tube sections have three radii of curvature, one of the radii of curvature forms a central radius of curvature which lies between the legs of the respective tube sections, and the remaining radii of curvature respectively forming a transistion from the legs of the tube sections to the free ends of the tube forks.

4. A heat exchanger according to one of claims 1 or 2, characterized in that the heat exchanger is a double flow heat exchanger over about 60–70% of a height of a heat exchanger surface thereof and a single-flow heat exchanger over a remaining portion of the height of the heat exchanger surface.

5. A heat exchanger according to one of claims 1 or 2, characterized in that each of the tube sections include an elbow portion interposed between two legs, and in that the elbow portions of the respective tube sections point in different directions.

6. A heat exchanger according to claim 5, characterized in that all of the tube sections have an identical construction.

7. A heat exchanger according to claim 6, characterized in that the elbow portions of all of the tube sections are disposed in a second plane extending perpendicular to the plane in which the legs of the respective tube forks are arranged, and in that the legs of the tube forks extend into the second plane.

8. A heat exchanger according to claim 7, characterized in that the legs of each of the tube sections subtend an obtuse angle such that the elbow portion and legs form a substantially V-shape.

9. A heat exchanger according to claim 8, characterized in that each of the tube sections have three radii of curvature, one of the radii of curvature forms a central radius of curvature which lies between the legs of the respective tube sections, and the remaining radii of curvature respectively forming a transistion from the legs of the tube sections to the free ends of the tube forks.

10. A heat exchanger according to claim 9, characterized that the heat exchanger is a double flow heat exchanger over about 60–70% of a height of a heat exchanger surface thereof and a single-flow heat exchanger over a remaining portion of the height of the heat exchanger surface.

11. A heat exchanger according to claim 5, characterized in that the elbow portions of all of the tube sections are disposed in a second plane extending perpendicular to the plane in which the legs of the respective tube forks are arranged, and in that the legs of the tube forks extend into the second plane.

12. A heat exchanger according to claim 11, characterized in that the legs of each of the tube sections subtend an obtuse angle such that the elbow portions and legs form a substantially V-shape.

13. A heat exchanger according to claim 12, characterized in that each of the tube sections have three radii of curvature, one of the radii of curvature forms a central radius of curvature which lies between the legs of the respective tube sections, and the remaining radii of curvature respectively forming a transistion from the legs of the tube sections to the free ends of the tube forks.

* * * * *